US007377390B2

(12) United States Patent
Modesto

(10) Patent No.: US 7,377,390 B2
(45) Date of Patent: May 27, 2008

(54) STAND FOR DOLL ATTACHMENT

(75) Inventor: Cesar Modesto, Maywood, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/853,775

(22) Filed: May 24, 2004

(65) Prior Publication Data

US 2005/0051678 A1 Mar. 10, 2005

Related U.S. Application Data

(60) Provisional application No. 60/484,624, filed on Jul. 2, 2003, provisional application No. 60/473,907, filed on May 27, 2003.

(51) Int. Cl.
*B65D 73/00* (2006.01)

(52) U.S. Cl. ..... 206/464; 206/477; 403/326

(58) Field of Classification Search ..... 248/71, 248/73, 74.2, 316.7, 682, 686, 689, 692; 24/530, 545, 546, 547, 563, 458; 206/477, 206/478, 480, 464, 471, 486; 446/268; 411/512, 525, 526; 403/240, 329, 326
See application file for complete search history.

(56) References Cited

U.S. PATENT DOCUMENTS

| | | | | | |
|---|---|---|---|---|---|
| 698,272 | A | * | 4/1902 | Glover | 211/39 |
| 735,453 | A | | 8/1903 | Bliven | |
| 1,544,303 | A | | 6/1925 | Fellows | |
| 2,018,198 | A | | 10/1935 | Baggett | |
| 2,169,067 | A | | 8/1939 | Dorsey | |
| 2,469,859 | A | * | 5/1949 | Charbeneau | 248/106 |
| 2,792,654 | A | | 5/1957 | Larson | |
| 2,979,554 | A | * | 4/1961 | Maitland | 174/138 G |
| RE25,182 | E | | 6/1962 | Larson | |
| 3,154,281 | A | * | 10/1964 | Frank | 248/201 |
| 3,515,363 | A | | 6/1970 | Fisher | |
| 3,702,612 | A | * | 11/1972 | Schlesinger | 604/180 |
| 3,811,565 | A | * | 5/1974 | Tancredi | 206/478 |
| 4,277,864 | A | | 7/1981 | Orson, Sr. | |
| 4,566,660 | A | | 1/1986 | Anscher et al. | |
| 4,669,688 | A | | 6/1987 | Itoh et al. | |
| 4,706,915 | A | | 11/1987 | Cindric et al. | |
| 4,815,175 | A | | 3/1989 | Kasai | |
| 4,840,334 | A | | 6/1989 | Kikuchi | |
| 4,917,340 | A | | 4/1990 | Jüemann et al. | |
| 5,039,040 | A | | 8/1991 | Idjakiren | |
| 5,249,802 | A | * | 10/1993 | McCarthy | 273/157 R |
| 5,367,750 | A | | 11/1994 | Ward | |

(Continued)

FOREIGN PATENT DOCUMENTS

| | | |
|---|---|---|
| GB | 2125477 | 3/1984 |

(Continued)

*Primary Examiner*—Alfred Joseph Wujciak
(74) *Attorney, Agent, or Firm*—Kolisch Hartwell, P.C.

(57) ABSTRACT

Display systems for toys. The display system includes a display stand with an aperture. An anchor member is mounted to the display stand and has an aperture bounded by at least one flange. A supporting member is further included and adapted to support a toy. The supporting member has a protrusion adapted to pass through the apertures in the display stand and the anchor member to engage selectively with the anchor member. In some embodiments, the supporting member has arcuate extensions that support the toy.

13 Claims, 5 Drawing Sheets

U.S. PATENT DOCUMENTS

| | | | | |
|---|---|---|---|---|
| 5,378,187 | A | 1/1995 | Forbes et al. | |
| 5,398,820 | A * | 3/1995 | Kiss | 211/13.1 |
| 5,490,651 | A | 2/1996 | Kump | |
| 5,551,656 | A | 9/1996 | De Lozada et al. | |
| 5,586,375 | A | 12/1996 | Cooperman et al. | |
| 5,640,742 | A | 6/1997 | White et al. | |
| 5,826,312 | A | 10/1998 | Schröder et al. | |
| 5,979,019 | A | 11/1999 | Johnson | |
| 5,983,468 | A | 11/1999 | Evans, III et al. | |
| 6,003,211 | A | 12/1999 | Chen | |
| 6,016,911 | A * | 1/2000 | Chen | 206/395 |
| 6,085,393 | A | 7/2000 | Tsui et al. | |
| 6,164,463 | A * | 12/2000 | Lee | 211/70.6 |
| 6,264,525 | B1 | 7/2001 | Guschlbauer | |
| 6,425,482 | B1 * | 7/2002 | Chiang | 206/349 |
| 6,513,206 | B1 * | 2/2003 | Banitt et al. | 24/459 |
| 6,575,302 | B2 * | 6/2003 | Robley, Jr. | 206/776 |
| 6,708,932 | B1 * | 3/2004 | Gazdik | 248/74.1 |
| 6,854,693 | B2 * | 2/2005 | Harrison et al. | 248/68.1 |
| 2003/0014844 | A1 | 1/2003 | Splane et al. | |
| 2004/0104314 | A1 * | 6/2004 | Harrison et al. | 248/68.1 |

FOREIGN PATENT DOCUMENTS

| | | | | |
|---|---|---|---|---|
| GB | 2243592 | A * | 6/1991 | |
| GB | 2243592 | A * | 11/1991 | |
| JP | 3-187876 | A * | 8/1991 | 206/477 |

* cited by examiner

STAND FOR DOLL ATTACHMENT

CROSS-REFERENCE TO RELATED APPLICATIONS

This application claims priority under 35 U.S.C. 119(e) to U.S. Provisional Patent Application No. 60/473,907 entitled "Stand For Doll Attachment," filed May 27, 2003, and U.S. Provisional Patent Application No. 60/484,624 entitled "Stand For Doll Attachment," filed Jul. 2, 2003, the disclosures of which are incorporated herein by reference.

BACKGROUND

The present invention relates generally to display stands for dolls or action figures, and more specifically, to a display stand to be used by a consumer. Articulated action figures and dolls are classic toys that provide imaginative fun for many children. Being able to support a doll on its own stand allows a child to play with multiple dolls at a time since the child does not need to hold each doll during play. Examples of known display stand for dolls are disclosed in U.S. Pat. Nos. 4,706,915, 5,378,187, 5,551,656 and 6,264,525, the disclosures of which are incorporated herein by reference.

SUMMARY

The display system of the present disclosure uses a two-piece connector to provide a support structure to support a doll adjacent a display stand. A first portion of the connector is attached to the stand, typically at the point of manufacture, and a second portion of the connector passes through the stand to engage with the first portion. The display stand has a scene printed thereon to provide a backdrop for the doll. The disclosed stand and connectors are therefore useful to a consumer to incorporate into play with the doll.

The advantages of the present invention will be understood more readily after a consideration of the drawings and the Detailed Description.

DETAILED DESCRIPTION

The disclosed display system may be used for play, display, or storage of a supported doll or action figure. By providing a simply constructed two-piece connector that attaches to a display stand, once the package has been opened, a child may quickly assemble the display system.

Figure 1:
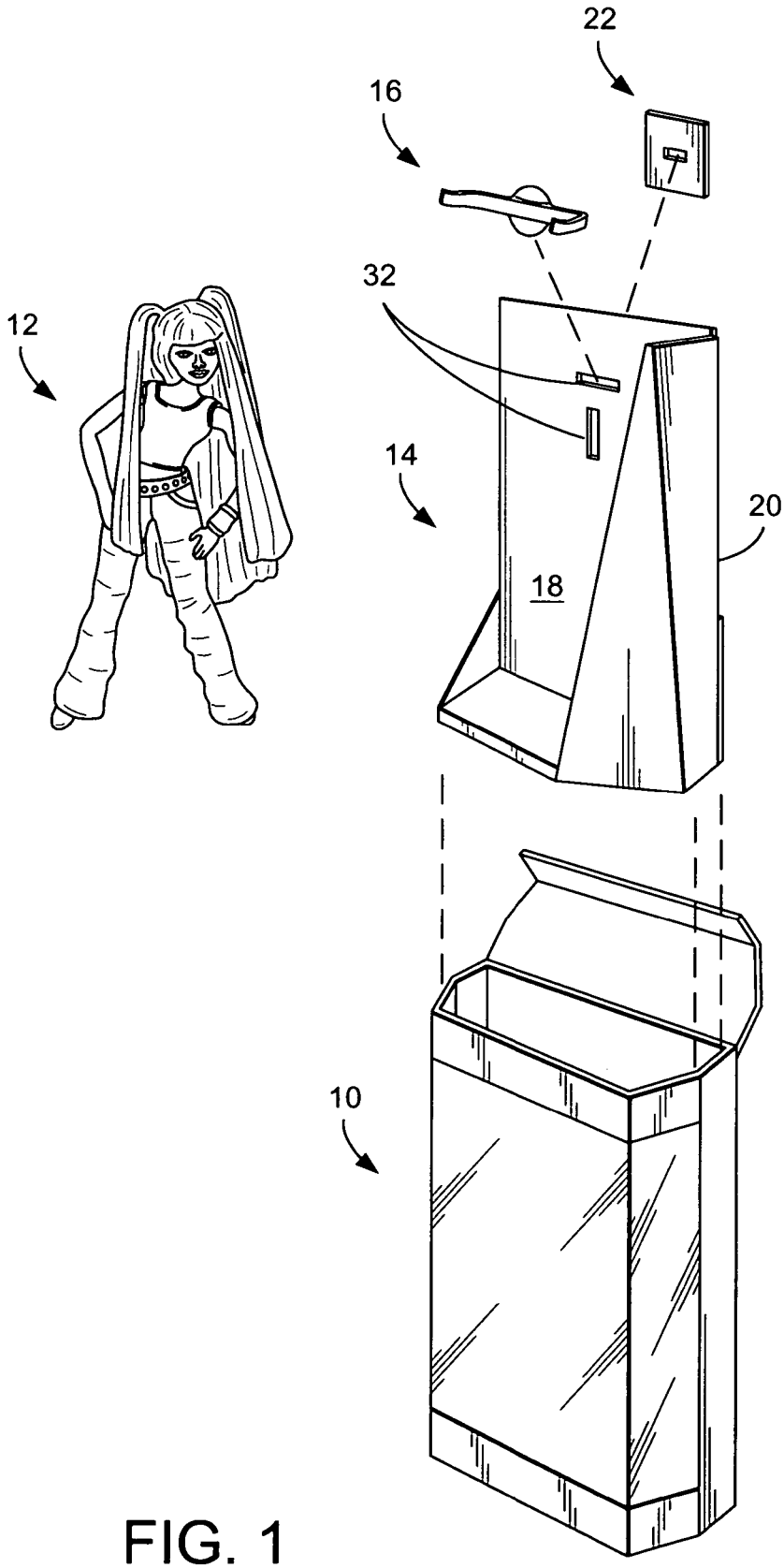
FIG. 1 shows an example of a doll and a display system, according to the present disclosure, including an exemplary display stand, an anchor member, and a supporting member.

A box 10 is commonly used to house doll 12 to protect the doll from damage. As depicted in FIG. 1, box 10 contains an insert or display stand 14 to which doll 12 is typically initially attached to prevent movement and possible damage of the doll during shipment. This attachment is through conventional means, such as twist-ties. A supporting member, or display hook, 16 is provided that a user may attach to the stand as will subsequently be described.

Figure 2A:
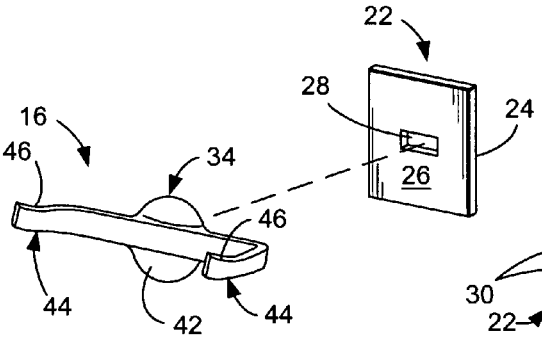
FIG. 2 illustrates details of the exemplary anchor member and the supporting member, including a front view in FIG. 2A and a rear view in FIG. 2B.
Figure 2B:
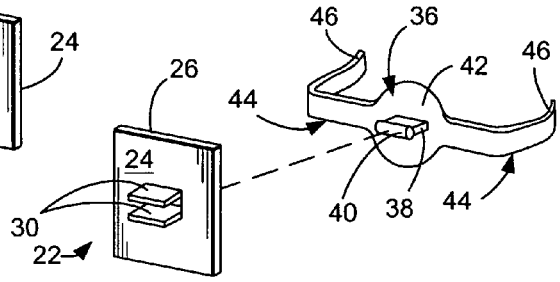

Once doll 12 is removed from stand 14, the stand may be prepared for post-shipment display. Stand 14 has a front 18 and a back 20, as illustrated in FIG. 1. An anchor member 22 may be attached to the stand to receive supporting member 16 and secure the supporting member to stand 14. As shown in FIGS. 2A and 2B, anchor member 22 has a front 24 and a back 26. The back of anchor member 24 may be fastened to the stand with glue, double-sided tape, hooks, Velcro, or other suitable fasteners. In some embodiments, anchor member 22 further includes an aperture 28 that is flanked by two flanges 30. Aperture 28 is configured to receive a portion of supporting member 16, as will subsequently be discussed.

In some embodiments, at least one aperture 32 passes through stand 14, as previously shown in FIG. 1. In such a configuration, aperture 28 of anchor member 22 may align with aperture 32 in the display stand. Supporting member 16 may then pass through aperture 32 to engage with anchor member 22. To enable stand 14 to support several dolls, or a user to select from a variety of locations on stand 14, a plurality of apertures 32 may be provided with stand 14. Further, apertures 32 may be located in a variety of orientations depending upon the doll or accessories to be supported.

Figure 3A:
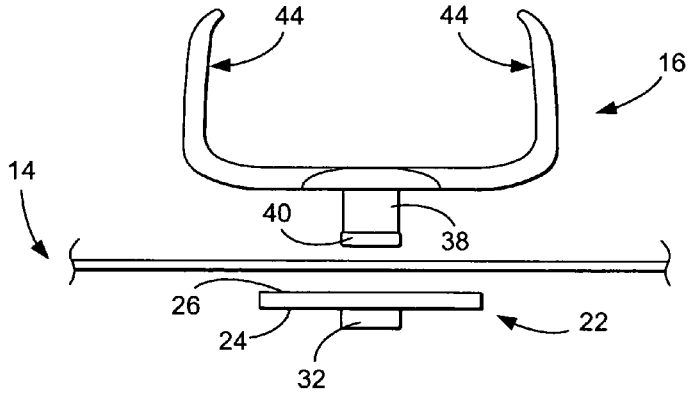
FIG. 3 illustrates assembly of the display system shown in FIG. 2, including a top view in FIG. 3A, before the display system is assembled, and a top view in FIG. 3B and a side view in FIG. 3C, after the display system is assembled.
Figure 3B:
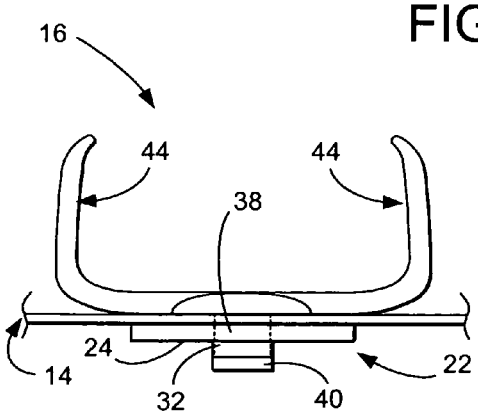
Figure 3C:
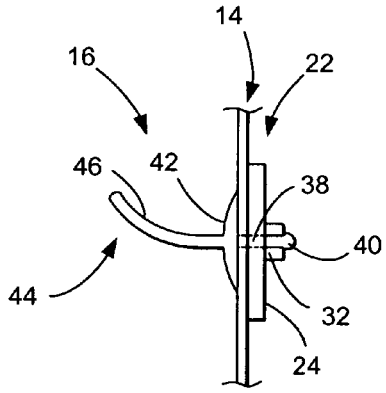

As shown in FIGS. 2A and 2B, supporting member 16 has a front 34 and a back 36. Extending from back 36 is a protrusion 38. Aperture 32 on stand 14 and aperture 28 of anchor member 22 are sized to allow passage of protrusion 38 through the display stand and into anchor member 22. In the example shown in FIG. 2B, the protrusion has an enlarged, or bulbous portion, such as cylindrical end 40 that passes between flanges 30 and secures the supporting member to the anchor member. This configuration provides a connection that is sufficiently strong to withstand the weight of doll 12, but yet allows a user to remove supporting member 16 from anchor member 22. As shown in FIGS. 3A, 3B, and 3C, supporting member 16 interlocks with anchor member 22 to provide a method of selectively attaching and detaching the supporting member while preventing unwanted detachment. Thus, a first portion of the connector, namely the anchor member, is attached to the stand typically at the point of manufacture, and a second portion of the connector, namely the supporting member, passes through the stand to engage with the first portion, when the doll is ready to be displayed. In some embodiments, a single flange 30 may be U-shaped and thereby wrap around a portion of protrusion 38 upon engagement.

The embodiment shown is intended as an example only and other configurations may be used to selectively couple supporting member 16 to anchor member 22 including, but not limited to, alternative press-fit configurations, snaps, hooks, tape, glue, and the like, and may provide either permanent or removable attachment of the supporting member. Anchor member 22 may also be integrally formed with stand 14.

Extending from front 34 of supporting member 16 are extensions 44. Extensions 44 may have arcuate edges 46 to assist in supporting doll 12, such as by scooping under the arms of doll 12. In some embodiments, extensions 44 may include additional mechanisms, such as clasps or Velcro, to assist in supporting doll 12 or any doll accessories.

A portion of supporting member 16 may form a disk 42 to prevent damage to the surrounding areas of stand 14 or assist in attachment or detachment of supporting member 16. It should be appreciated that disk 42 may take a variety of configurations and that shown is intended as only one example. In some embodiments, this widened region may assist in preventing damage to display stand 14 by preventing movement of the supporting member relative to the stand. Since some stands are made of cardboard, limiting motion around aperture 32 may limit fraying of the stand. A widened region may also assist a user in removing supporting member 16 from anchor member 22 by providing a structure that may be used as a handle so a user does not damage extensions 44.

A user may be provided with more than one supporting member 16. In which case, stand 14 would also include multiple apertures 32 to allow connection of multiple anchor members 22 and supporting members 16. A user may therefore choose which of these additional mounting locations to use to achieve more complicated poses of the doll or to position doll accessories. Supporting members 16 and matching anchor members 22 could therefore be of varying sizes and of varying extension 44 shapes to provide appropriate support.

Figure 4A:
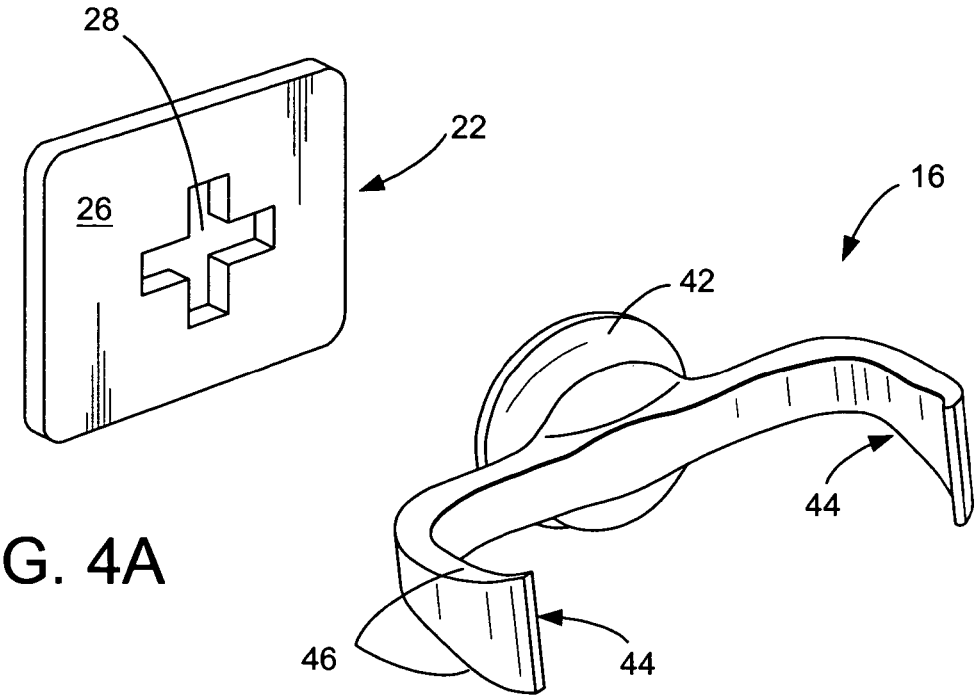
FIG. 4 illustrates another embodiment of the anchor member and supporting member, including a front view in FIG. 4A and a rear view in FIG. 4B.
Figure 4B:
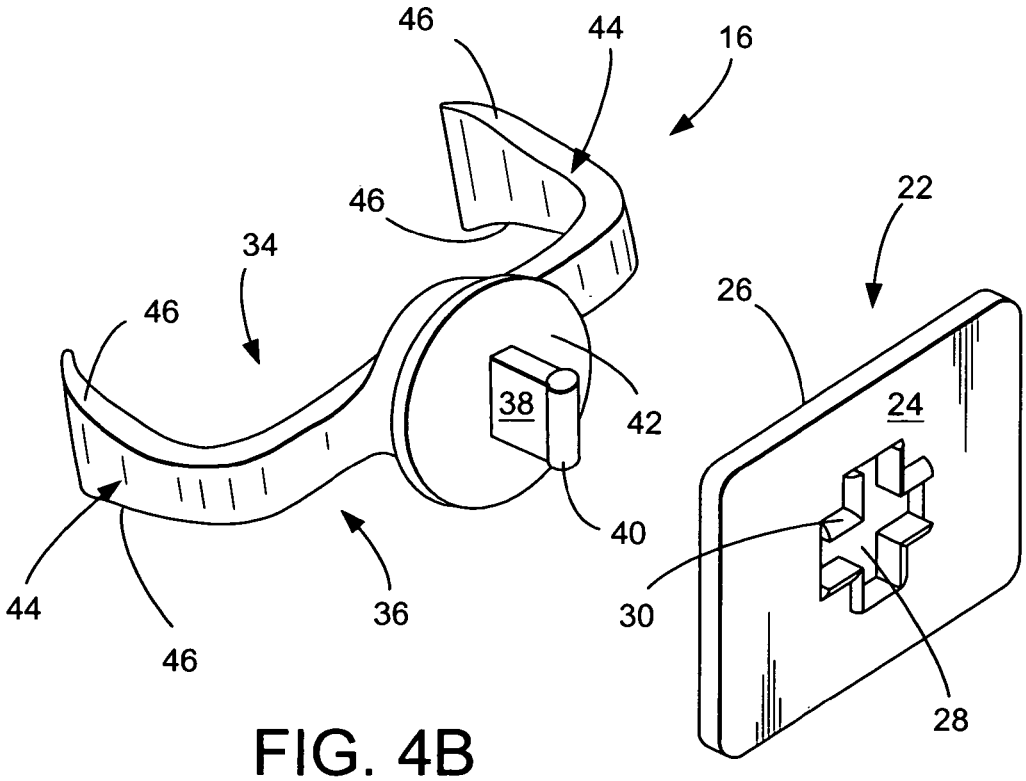

In some embodiments, each anchor member 22 may include multiple apertures or a complexly shaped aperture 28 and flanges 30, as shown in FIG. 4. Such a configuration allows multiple supporting member orientations. Thus, in some embodiments, the aperture in the anchor member is adapted to receive the protrusion of the supporting member in a variety of orientations. In the example shown, the aperture forms a cross shape and is adapted to receive the protrusion in at least a first orientation and a second orientation that are substantially perpendicular to one another. The embodiment shown in FIGS. 4A and 4B illustrates arms 42 of the display hook being symmetrically angled so that a user may attach the supporting member to the stand in either orientation. Thus, a user need not attach the supporting member in a particular manner to maintain functionality. This feature allows a child to use the device without the assistance of an adult.

Figure 5:
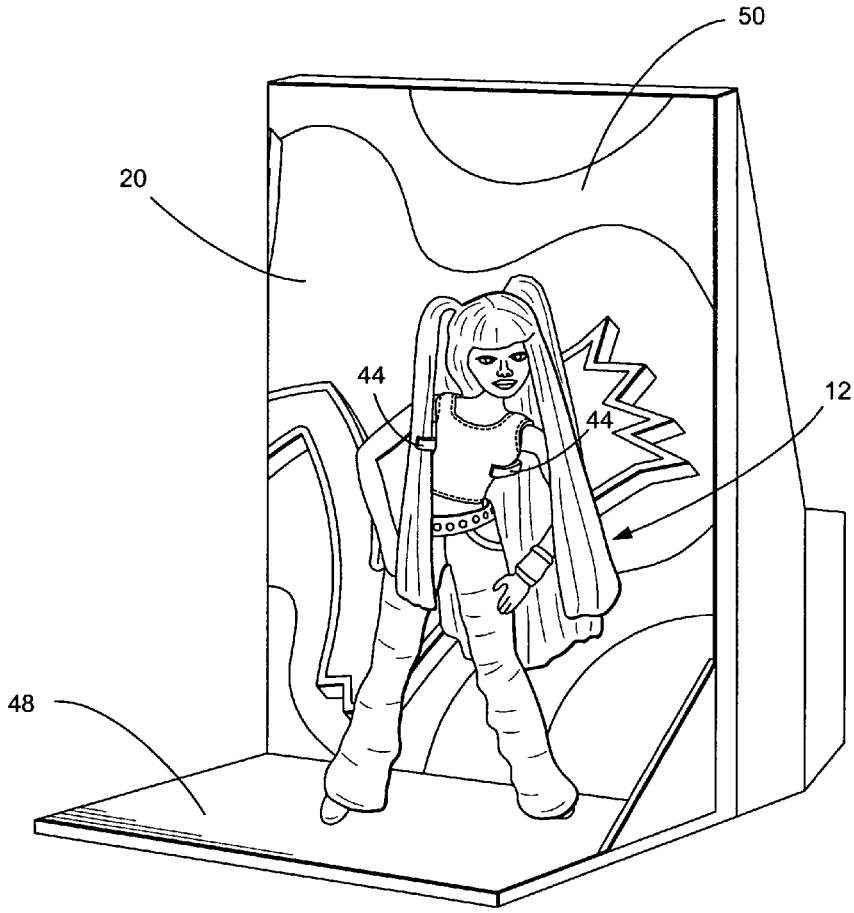
FIG. 5 illustrates a doll supported by the display system.

On either front 18, back 20, or both the front and the back of the display stand may be disposed at least one flap 48. As shown in FIG. 5, flap 48 is attached to back 20. Flap 48 may fold away from stand 14 so that an expanded surface is provided, such as a floor space on which to stand doll 12. These flaps may exist in any number and be affixed to any location of the display stand to provide more play options and locations to attach supporting members 16.

Figure 6:
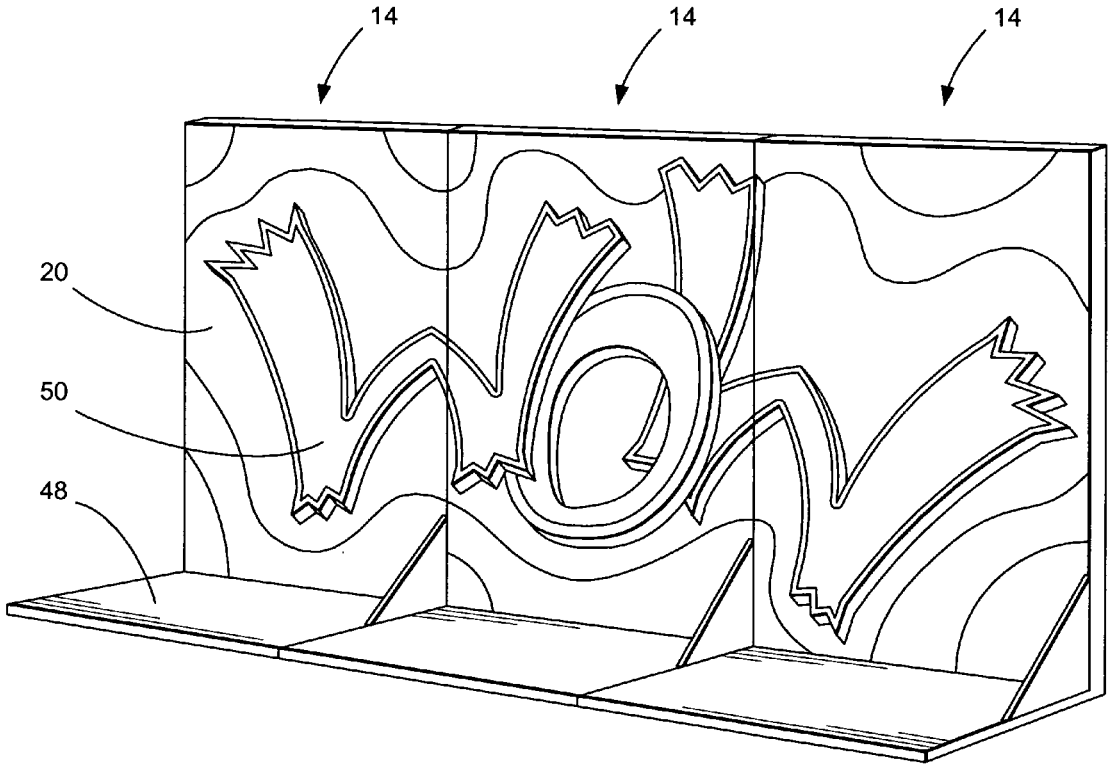
FIG. 6 depicts multiple display stands set adjacent one another to form a continuous backdrop scene.

Moving on to FIGS. 5 and 6, on front 18, back 20, or both the front and the back is depicted a scene 50. Scene 50 typically relates to the type of doll 12 packaged with stand 14. Flap 48 may therefore be designed to extend in any direction appropriate to expand scene 50. Anchor member 22 may attach to front 18 or back 20 depending on which side of the stand scene 50 has been placed. For example if the scene were imprinted on the back, then anchor member 22 would typically be attached to the front. A variety of scenes 50 may be available and may combine to produce a continuous scene 50 behind dolls 12, such as the scene shown in FIG. 6. Additionally, providing multiple locations for supporting member 16, as previously described, would allow a child to place a doll on another doll's stand to change the scene for a wider variety of play options.

During use, box 10 is opened to remove stand 14 containing doll 12 and any other items contained in box 10, such as clothing, backpacks, hair brushes, radios, and a graffiti kit. Once removed, stand 14 is typically turned around so that scene 50 printed on back 20 is visible. Supporting member 16 is then attached to anchor member 22 as previously described.

Alternatively, box 10 and stand 14 may be fully integrated in such a way that box 10 may be refolded or have a portion removed to transform box 10 into stand 14. Anchor member 22 and supporting member 16 may have other structure to attach the receiver to the display hook instead of aperture 28 and protrusion 38, such as Velcro, snaps, or glue as previously mentioned. Additionally, anchor member 22 may not be attached to the display stand prior to sale to a user, therefore a user is able to select his or her preferred location to attach the receiver and display hook. Thus, the present disclosure provides several options for supporting a doll with a display stand.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

I claim:

1. A display system for a toy comprising:

a support device for supporting an object relative to a base, the support device comprising:

supporting member adapted to support an object relative to a base and including a disk adapted to restrict movement of the supporting member relative to the base and at least one protrusion forming a bulbous portion and extending from the back of the disk; and an anchor member adapted to be coupled selectively to a base and adapted to receive the protrusion through an aperture in the anchor member, wherein the anchor mcmber has at least one flange that extends adjacent opposing sides of the aperture, positioned to flank the protrusion and thereby restrict relative motion between the at least one flange and the protrusion, and further wherein the bulbous portion extends beyond the at least one flange; and a base in the form of a packaging insert configured as a display stand with a front and a back, the packaging insert being adapted to be folded into at least a portion of a box suitable for shipping a toy and including at least one flap adapted to expand the packaging insert;

wherein the anchor member is mounted to one of the front and the back of the packaging insert, and the supporting member is adapted to engage selectively with the anchor member and the front of the supporting member includes at least one extension adapted to releasably support a toy.

2. The display system of claim 1, wherein the at least one extension is arcuate.

3. The display system of claim 1, wherein the packaging insert is imprinted with at least a portion of a scene.

4. The display system of claim 3, wherein the packaging insert is adapted to be placed next to other packaging inserts to form a complete scene.

5. The display system of claim 1, wherein the anchor member is integrally formed with the packaging insert.

6. The display system of claim 1, wherein the supporting member includes a disk adapted to restrict movement of the supporting member relative to the packaging insert.

7. The display system of claim 1, wherein the at least one extension is symmetrically angled.

8. A display system for a toy comprising:

a support device for supporting an object relative to a base, the support device comprising:

a supporting member adapted to support an object relative to a base and including a disk adapted to restrict movement of the supporting member relative to the base and at least one protrusion forming a bulbous portion and extending from the back of the disk; and an anchor member adapted to be coupled selectively to a base and including an aperture bounded by at least one flange, the aperture forming a cross shape and adapted to receive the protrusion in at least a first orientation and a second orientation that are substantially perpendicular to one another, wherein the at least one flange extends adjacent opposing sides of the aperture and is positioned to flank the protrusion and thereby restrict relative motion between the at least one flange and the protrusion, and further wherein the bulbous portion extends beyond the at least one flange; and a base in the form of a packaging insert configured as a display stand with a front and a back, the packaging insert being adapted to be folded into at least a portion of a box suitable for shipping a toy and including at least one flap adapted to expand the packaging insert;

wherein the anchor member is mounted to one of the front and the back of the packaging insert, and the supporting member is adapted to engage selectively with the anchor member and the front of the supporting member includes at least one extension adapted to releasably support a toy.

9. The display system of claim 8, wherein the at least one extension is arcuate.

10. A display system for a toy comprising:

a support device for supporting an object relative to a base, the support device comprising:

a supporting member adapted to support an object relative to a base and including a disk adapted to restrict movement of the supporting member relative to the base and at least one protrusion forming a bulbous portion and extending from the back of the disk; and an anchor member adapted to be coupled selectively to a base and adapted to receive the protrusion through an aperture in the anchor member, wherein the anchor member has at least one flange that extends adjacent opposing sides of the aperture, positioned to flank the protrusion and thereby restrict relative motion between the at least one flange and the protrusion, and further wherein the bulbous portion extends beyond the at least one flange; and a portion of a shipping container configured to form a display stand with an aperture, wherein the portion of the shipping container is imprinted with at least a portion of a scene and includes at least one flap adapted to extend the scene;

wherein the anchor member is coupled to the portion of the shipping container adjacent the aperture, and the supporting member includes at least one extension adapted to releasably support a toy.

11. The display system of claim 10, wherein the at least one extension is arcuate along at least one edge.

12. The display system of claim 10, wherein the aperture in the anchor member is shaped to receive the supporting member in several orientations.

13. The display system of claim 10, wherein the supporting member is positioned on a side of the portion of the shipping container opposite a substantial portion of the anchor member.

* * * * *